US010125582B1

(12) United States Patent
Johnson

(10) Patent No.: US 10,125,582 B1
(45) Date of Patent: Nov. 13, 2018

(54) ROTATOR ARM STOP AND ROLLER ASSEMBLY

(71) Applicant: JW Johnson Equipment Leasing Company, Tioga, ND (US)

(72) Inventor: Wesley J Johnson, Tioga, ND (US)

(73) Assignee: JW Johnson Equipment Leasing Company, Tioga, ND (US)

( * ) Notice: Subject to any disclaimer, the term of this patent is extended or adjusted under 35 U.S.C. 154(b) by 306 days.

(21) Appl. No.: 15/131,166

(22) Filed: Apr. 18, 2016

Related U.S. Application Data

(60) Provisional application No. 62/148,872, filed on Apr. 17, 2015.

(51) Int. Cl.
*E21B 43/12* (2006.01)

(52) U.S. Cl.
CPC ..... *E21B 43/121* (2013.01); *E21B 43/127* (2013.01)

(58) Field of Classification Search
CPC ..... E21B 43/127
See application file for complete search history.

(56) References Cited

U.S. PATENT DOCUMENTS 2,471,198 A * 5/1949 Cormany ..... E21B 33/0415 166/78.1
2,595,434 A * 5/1952 Williams ..... E21B 33/0415 166/78.1
2,870,715 A * 1/1959 Barrett ..... E21B 43/12 417/85
3,089,428 A * 5/1963 Johnston ..... F16K 29/00 166/72
5,427,178 A * 6/1995 Bland ..... E21B 33/0415 166/78.1
6,026,898 A * 2/2000 Bland ..... E21B 33/0415 166/78.1
6,834,717 B2 * 12/2004 Bland ..... E21B 33/0415 166/75.14
8,381,819 B2 * 2/2013 Fern ..... E21B 33/0415 166/339
9,140,113 B2 * 9/2015 Hurst ..... E21B 47/0008

* cited by examiner

*Primary Examiner* — Robert E Fuller
(74) *Attorney, Agent, or Firm* — Edward S. Sherman

(57) ABSTRACT

A petroleum extraction pump deploying a sucker rod has an actuator for rotating the portion of the rod in the stuffing box on every stroke to minimize local wear. The rotor handle or arm of the actuator is triggered by an upright roller supported by a an upright rigid linear member, such as a post or tube, that is spaced apart from the well bore by a clamp attached to the main well pipe or stuffing box. The roller rotates with each stroke as it engages the rotator handle. The roller is supported by a Y-shaped saddle to avoid catching on the upstroke of the pumping unit should these member become laterally separated. The device is capable of retrofitting to an existing sucker rod actuator by eliminating a cable to the arm of the actuator and deploying an arm stop member to support the handle in a horizontal orientation until it contacts the roller.

19 Claims, 16 Drawing Sheets

FIG. 5A
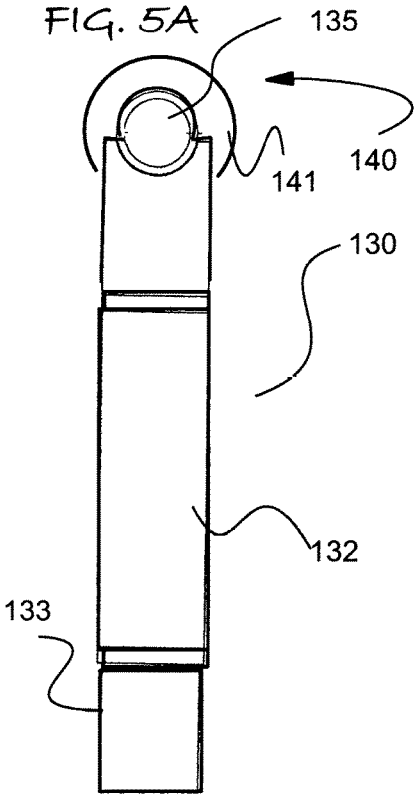
FIG. 5B
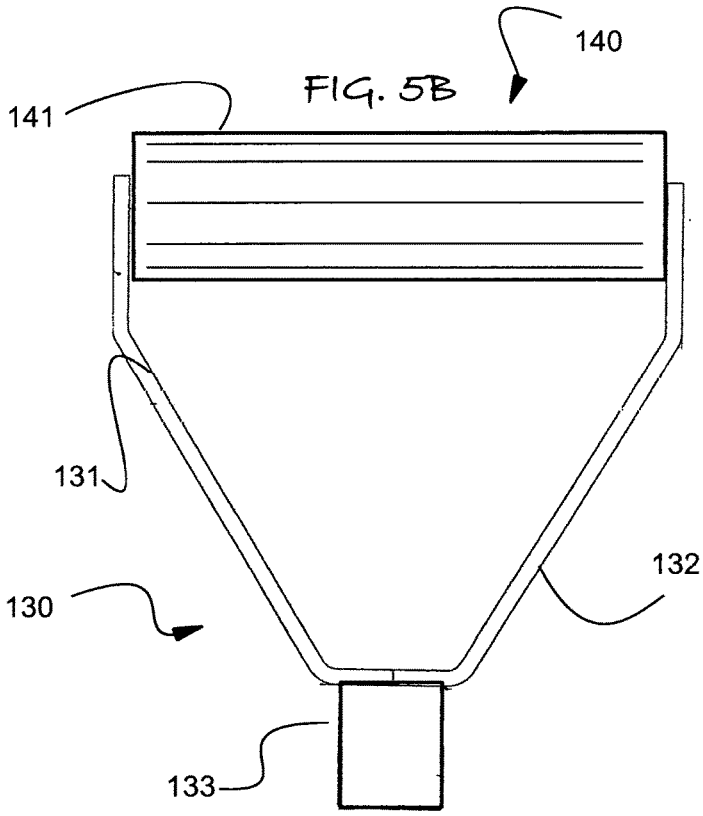
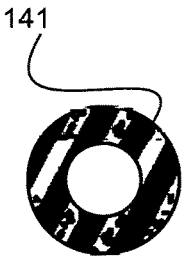
FIG. 5C
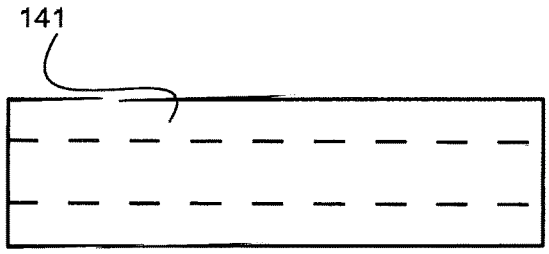
FIG. 5D

ROTATOR ARM STOP AND ROLLER ASSEMBLY

CROSS REFERENCE TO RELATED APPLICATIONS

The present application claims the benefit of priority to the US Provisional Patent application of the same title that was filed on Apr. 17, 2016, having application No. 62/148,872, and is incorporated herein by reference.

BACKGROUND OF INVENTION

The field of inventions is wellhead equipment and is intended for use in oil wells, where extraction is carried out by using pumping equipment with reciprocating sucker rods.

U.S. Pat. No. 1,623,696 disclosures a sucker rod rotator 22 that deploys a stop post 36 to rotate an actuator handle 35. The sucker rod 19 enters the well head from the top of the stuffing box 14 and extends past the pumping T 15 into the well. Oil pumped from the well is expelled through the pumping T port connected to the horizontal pipe on each upward stroke of the sucker rod 19 by the overhead pivoting beam 11/12; the end of the actuator handle will hit the top of the post 36, causing the sucker rod 19 to rotate within the rotator 22. It does not show how the stop post 36 is supported or any structure on the stop post 36. The sucker rod 19 is rotated to reduce local wear in the stuffing box and prevent leaks at the seal therein, as well as maintain pumping efficiency.

Advances in well head instrumentation have improved the efficiency of oil pumping, but also increased the complexity and hence vulnerably of the components. Instrumentation has also increased the mechanical complexity.

There is a need for high reliability in all weather reconditions with exposure to oil field chemicals, drilling and petroleum residue. Hence, components must be highly corrosion resistant. Mechanical parts that move also must not jam. Jamming can damage components as well as cause the failure of the sucker rod rotator, leading to leaks and expensive repairs as well as non-productive down time for the well.

In some more modern installations, the rotator arm 35 is actuated by a cable that extends upwards to a fixed portion of the rig; hence as the rotator 22 moves with the sucker rod 19, the cable on each downward stroke will urge the arm 35 upward.

However, this configuration can become problematic if the cable is tangled, cut or otherwise disengage from either the upper portion of the rig or the arm 35. However, additional overhead cables are used for other purposes, primarily to carry signal wires to a load cell or other well head instrumentation, which by overhead placement clears the cable up and away from workers and adjacent equipment. However, such multiple cables can more easily become twisted and entangle with each other in high winds.

Accordingly, it is a first to objective of the invention to provide an improved means to activate a sucker rod rotator, and for the secure attachment of such means that is more reliable, will not jam or corrode with extended use.

The above and other objects, effects, features, and advantages of the present invention will become more apparent from the following description of the embodiments thereof taken in conjunction with the accompanying drawings

SUMMARY OF INVENTION

In the present invention, the first object is achieved by providing a sucker rod actuator stop comprising a wellhead clamp having a first cylindrical clamp and a second spaced apart clamp means, an upright post attached at a proximal end thereof to the second clamp means, the post having a distal end opposing the proximal end, a saddle bracket having a pair of outward extending upright arms connected at a common proximal end to the distal end of the upright post, each arm having a distal end opposite the proximal end that is spaced apart from the distal end of the other arm, and a cylindrical roller having opposing sides about a cylindrical axis that is disposed in rotary engagement with the distal ends of each of the upright arms of the saddle.

A second aspect of the invention is characterized in by a well head conversion kit comprising one or more clamp means, a post for attachment to the clamp means, a saddle bracket for attachment to a top of the post distal from the attachment to the clamp means, and a roller attached to the top of the saddle bracket.

Another aspect of the invention is characterized in by the well head conversion further comprising an insulating collar and/or an arm stop.

The above and other objects, effects, features, and advantages of the present invention will become more apparent from the following description of the embodiments thereof taken in conjunction with the accompanying drawings.

BRIEF DESCRIPTION OF DRAWINGS

FIG. 5A is a side elevation view of the saddle bracket shown in FIG. 4, FIG. 5B is a front elevation view thereof, FIG. 5C is a cross-sectional elevation view of the roller in FIG. 5B and FIG. 5D is a side elevation view of the roller.

FIG. 7A is a side exterior elevation view of the stuffing box clamp 110 shown in FIG. 2, whereas

FIG. 9A is a side exterior elevation view of the pumping T clamp 1104 shown in FIG. 3, whereas

FIG. 13A a perspective view of a portion of arm stop of FIG. 2, whereas

FIG. 15A is a cross-sectional elevation of the plate component of the insulating collar in FIG. 14, whereas

DETAILED DESCRIPTION

Figure 1:
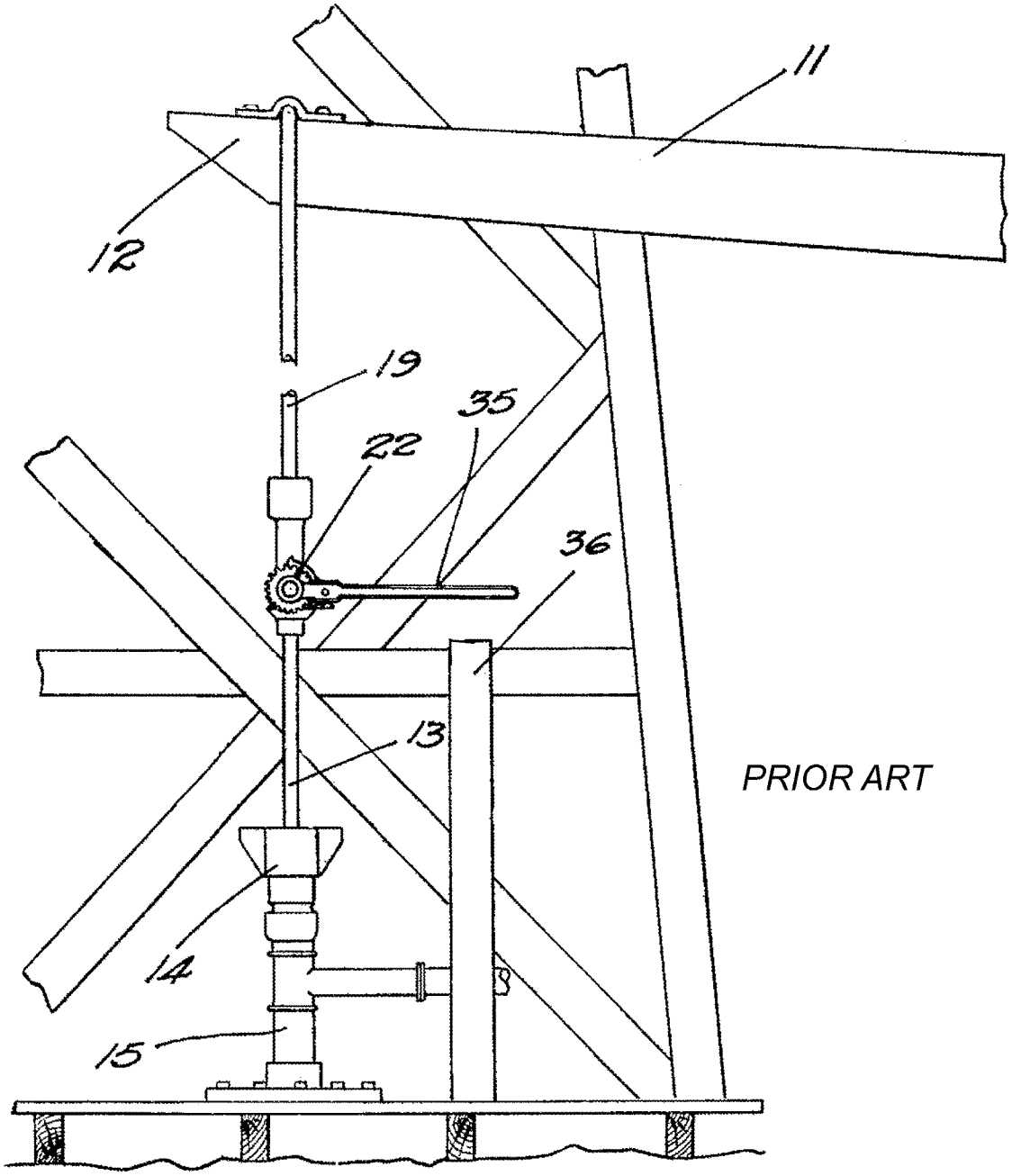
FIG. 1 is a schematic diagram of a prior art pumping mechanism at a well head that deploys a means to rotate the sucker rod.
Figure 2:
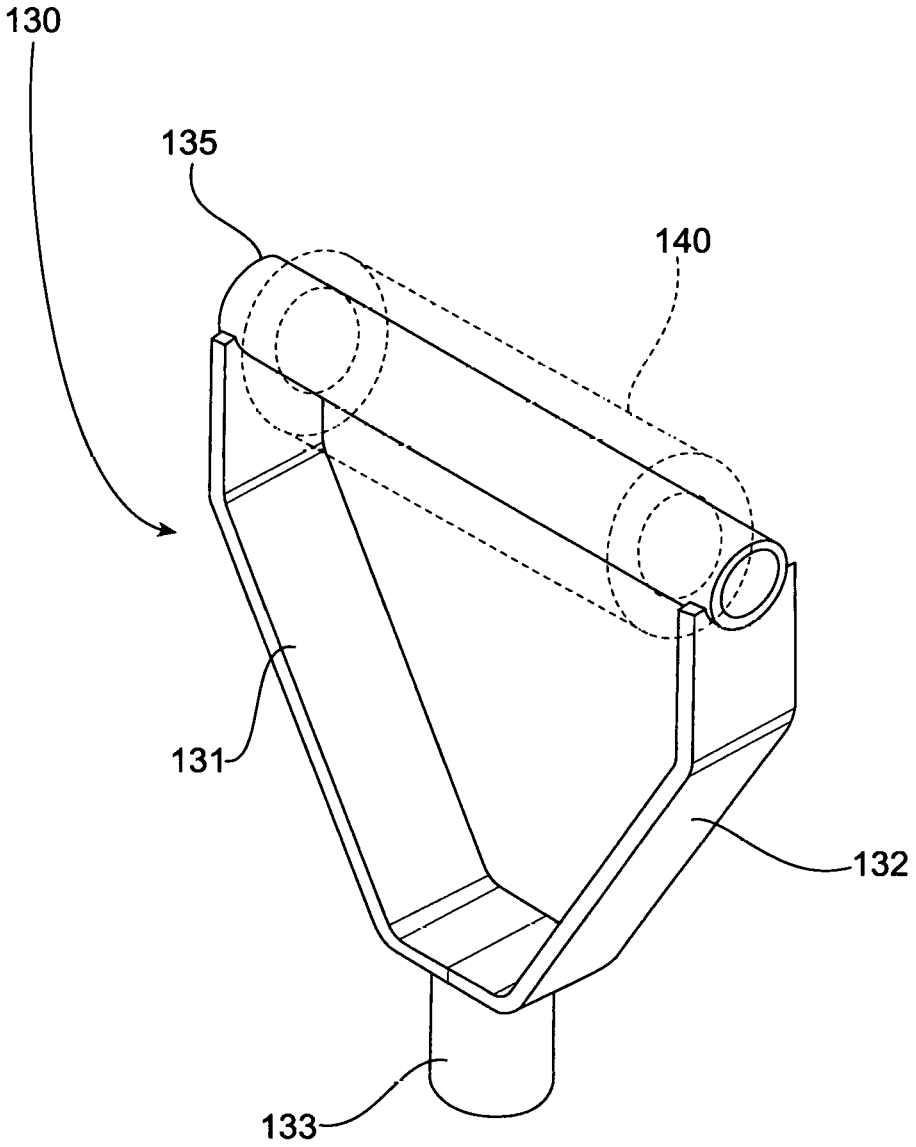
FIG. 2 is a perspective view of a preferred embodiment of the invention as deployed on a portion of a well head pump assembly.
Figure 3:
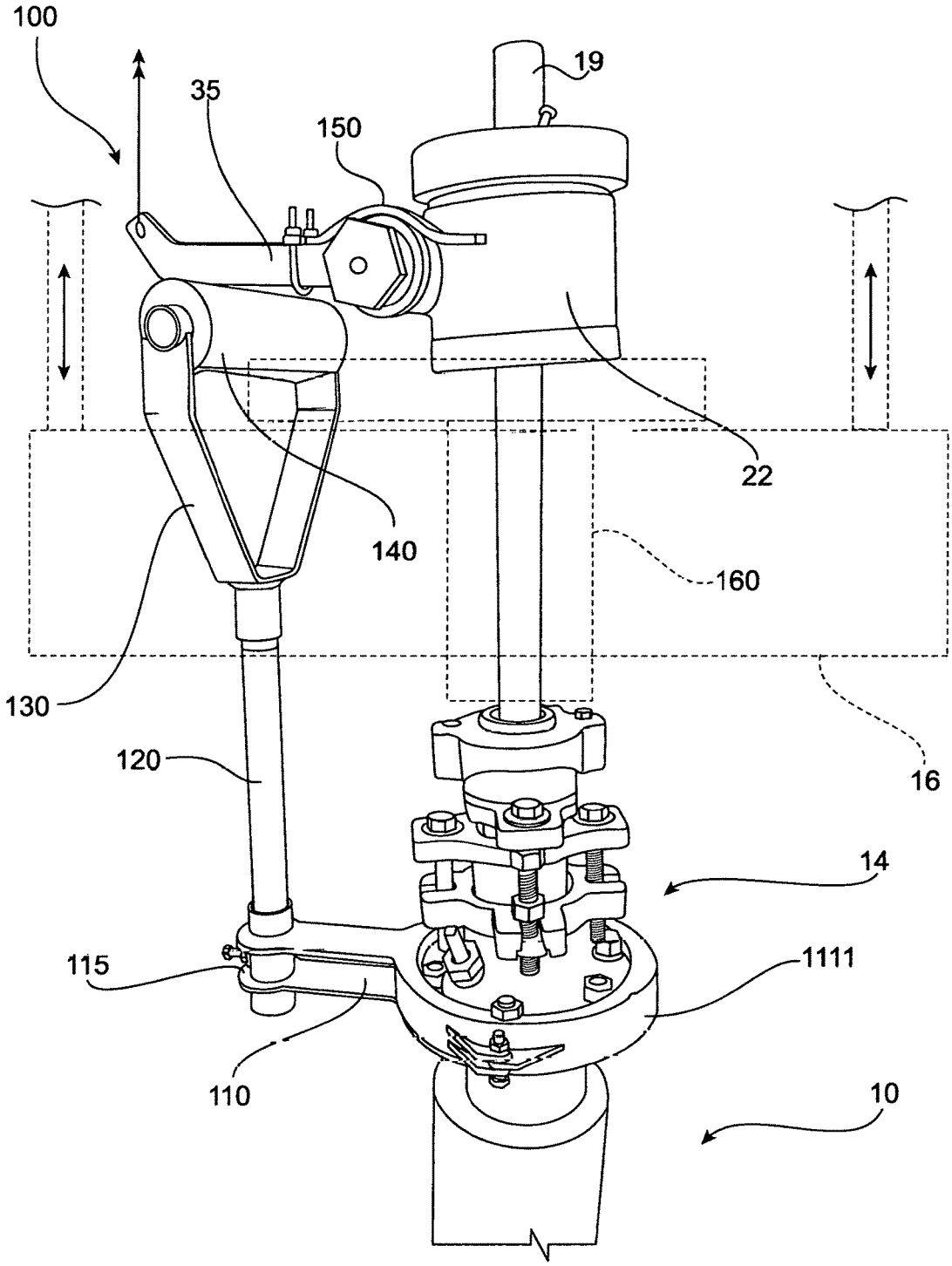
FIG. 3 is a perspective view of an alternative embodiment of supports for the post.

Referring to FIGS. 1 through 16, wherein like reference numerals refer to like components in the various views, there is illustrated therein a new and improved Rotator Arm Stop and Roller Assembly, generally denominated 100 herein.

In summary, the preferred and other embodiments of the invention described above improve well operation reliability in all weather reconditions with exposure to oil field chemicals, drilling and petroleum residue by providing a corrosion resistant combination of materials and contacting surfaces.

In accordance with the present invention the Rotator Arm Stop and Roller Assembly 100 comprises a clamp device 110 having a first cylindrical clamp assembly 111/111', a rigid linear member 118 is connected at a proximal end to the cylindrical clamp assembly. The rigid linear member 118 is in turn connected at the opposing or distal end to a second cylindrical clamp means, such as tube 115. An upright post 120 is attached to the second cylindrical clamp means. The upper end of the upright post 120 support a saddle bracket 130 having arms 131 and 132 that extend upward and outward from the other at the point of attachment to the top of the upright post 120. A cylindrical roller 14 in rotary engagement with and supported by upper ends of the saddle arms 131 and 132.

In well head 10 a sucker rod 19 enters the top of the stuffing box 14 and extends past the pumping "T" 15 into the well. The sucker rod rotator 22 is activated to rotate the sucker rod 19 with each stroke of the actuator handle or arm 35. Oil pumped from the well is expelled through the pumping "T" port connected to the horizontal pipe on each upstroke of the sucker rod 19. On each following down stroke of the sucker rod 19, the end of the actuator handle 35 will hit the roller 140 on the top of upright post 120, activating the rotator 22 and thus causing the sucker rod 19 to rotate within the rotator 22.

Hence, in using an embodiment of the present invention, the actuator handle 35 rather than being pulled upward on the down stroke by a cable, is urged upward when it contacts the cylindrical roller 140. Hence, an overhead cable can be eliminated, which avoids snagging, twisting or catching with instrumentation cables and damaging expensive instrumentation on the well head, improving reliability.

The roller 140 rotates with each stroke preventing wear on a single spot from the actuator arm 35 extending the component life. Moreover, the width of the roller 140 assures contact with the actuator arm 35 should either component rotate with respect to the other around the cylindrical axis defined by the upright sucker rod 19.

Should the position of the roller 140 and actuator arm 35 deviate by so much that contact will not be made on the down stroke, the sloped arms 131 and 132 that support the roller 140 preclude snagging of the actuator arm 35 on the upstroke, allowing manual re-adjustments in place.

Preferably, the top edge of the cylindrical roller 140 is disposed above the distal end of each of the opposing saddle arms 131 and 132.

More preferably, the saddle bracket 130 structure deploys integrated arms that are attached to a threaded pipe segment at the common end for attachment to the upright post formed from a threaded pipe.

The roller 140 is preferably plastic or rubber, but more preferably rubber or plastic cover or cladding 141 slid over a metal core 135. The roller 140 is non conductive to preclude electrolysis of the pumping unit components when used with the extended tube illustrated in FIG. 4 and FIG. 14-16. The installation of the supported roller 140 eliminates the need to attach a cable to the actuator arm 35, which can catch and foul the load cell cable wires, damaging load cell having a replacement cost of circa $3,500 at the time of this application.

The upright post 120 is preferably connect to the roller supporting saddle 130 assembly 130 via a cylindrical collar 133 directly connected to arms 131 and 132 by welds.

Figure 4:
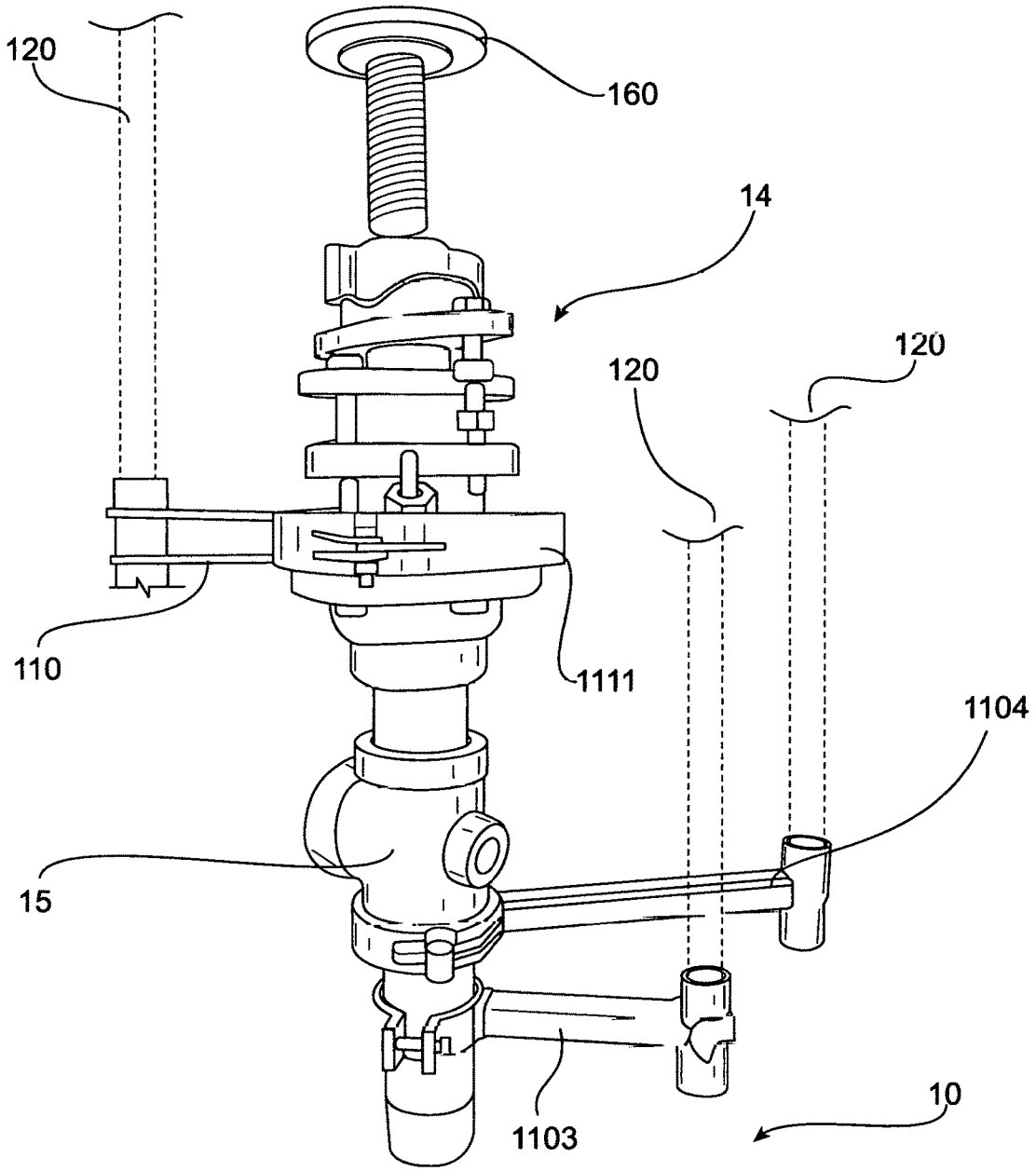
FIG. 4 is a perspective view of the saddle bracket and roller shown in FIG. 2.

The upright post 120 is spaced away from but supported by the well head assembly by any of the spacing clamps 110, 1103 and 1103' illustrated in FIG. 4, each of which is shown in greater details in FIG. 6-12.

The various spacing clamps 110, 1103 and 1103' connect to the well head 10 proximal to the stuffing box 14, with each configured for a specific location as is illustrated in FIG. 4. Each spacing clamp has the well head attachment member generally constructed as hinged mirror image C-shape portion 111 and 111' with protruding closure ends 112 and 112' distal from the connecting spring or hinge 113. When the connected C-shaped portions 111 and 111' are placed around a portion of the well head 10 the closure ends 112 and 112' are brought together and connected. The connection of the closure ends 112 and 112' is preferably via a bolt enters the common bore 112*a* of both closure ends 112 and 112' which is then securely clamped around the well head 10 when a mating nut is tightened on the bolt. The bolt and nut, or any other type of conventional fasteners which can be deployed to tighten the C-shaped portion about the well head structure, are not illustrated.

The opposing end 115 of the clamp is a cylindrical tube to receive the post 120, and hold it in place with one or more set screws that are received in external threaded fitting 116. The cylindrical tube 115 and one of the C-shaped portions 111 and 111' are connected by a rigid linear member 118, such as a bar, tube or pair of parallel plates and the like. The post 120 preferably has at least holes adjacent the lower end that are spaced at 90° about the tube axis to receive the set screws.

Figure 6:
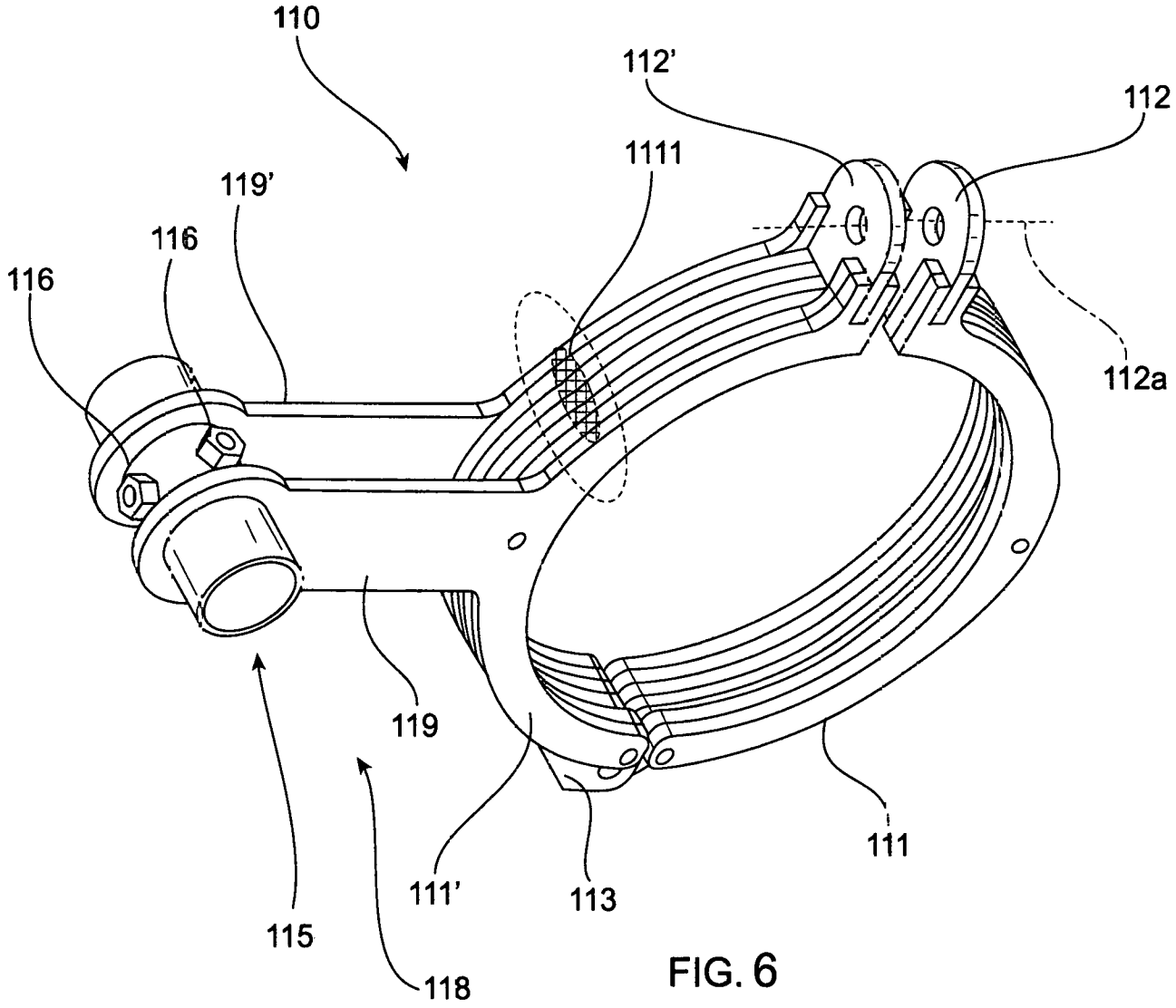
FIG. 6 is a perspective view of the stuffing box clamp 110 shown in FIG. 2.
Figure 7A:
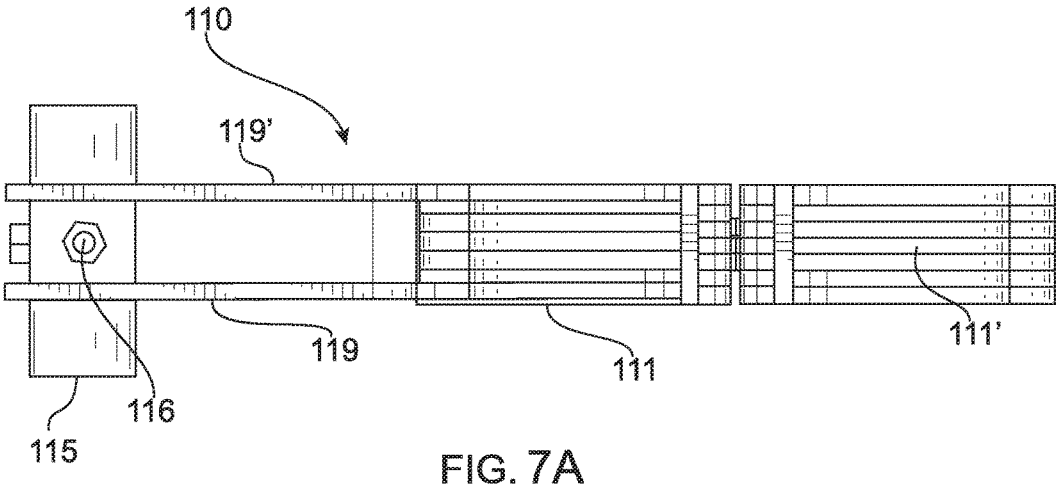
Figure 7B:
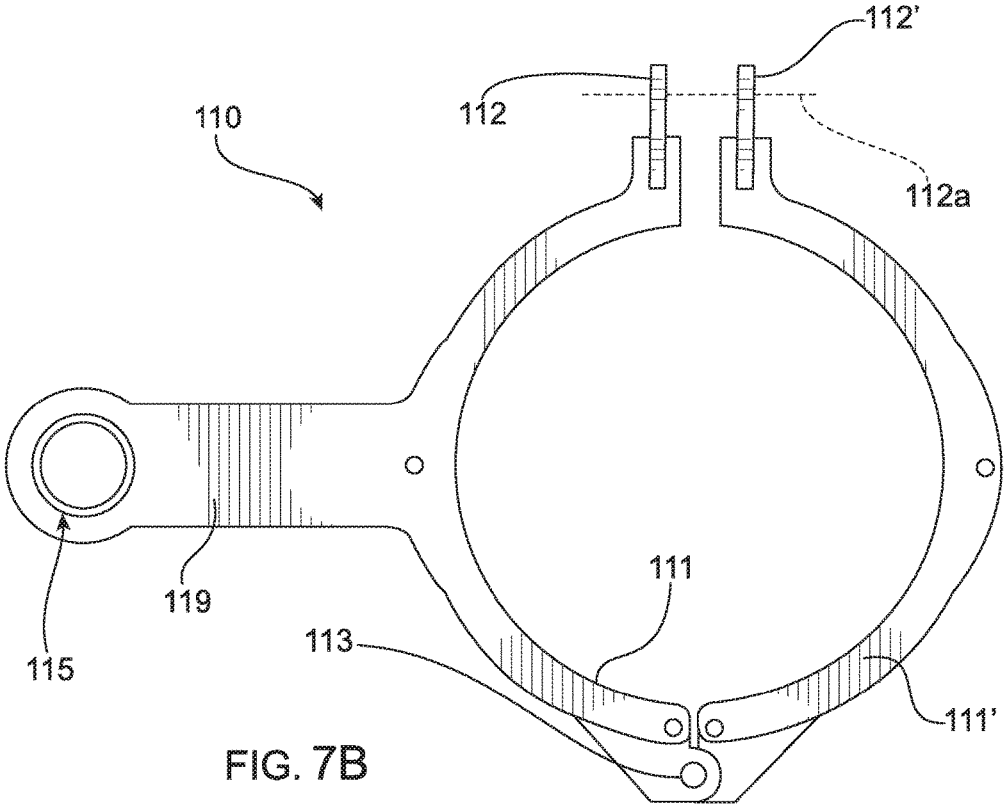
FIG. 7B is a top plan view thereof.
Figure 8:
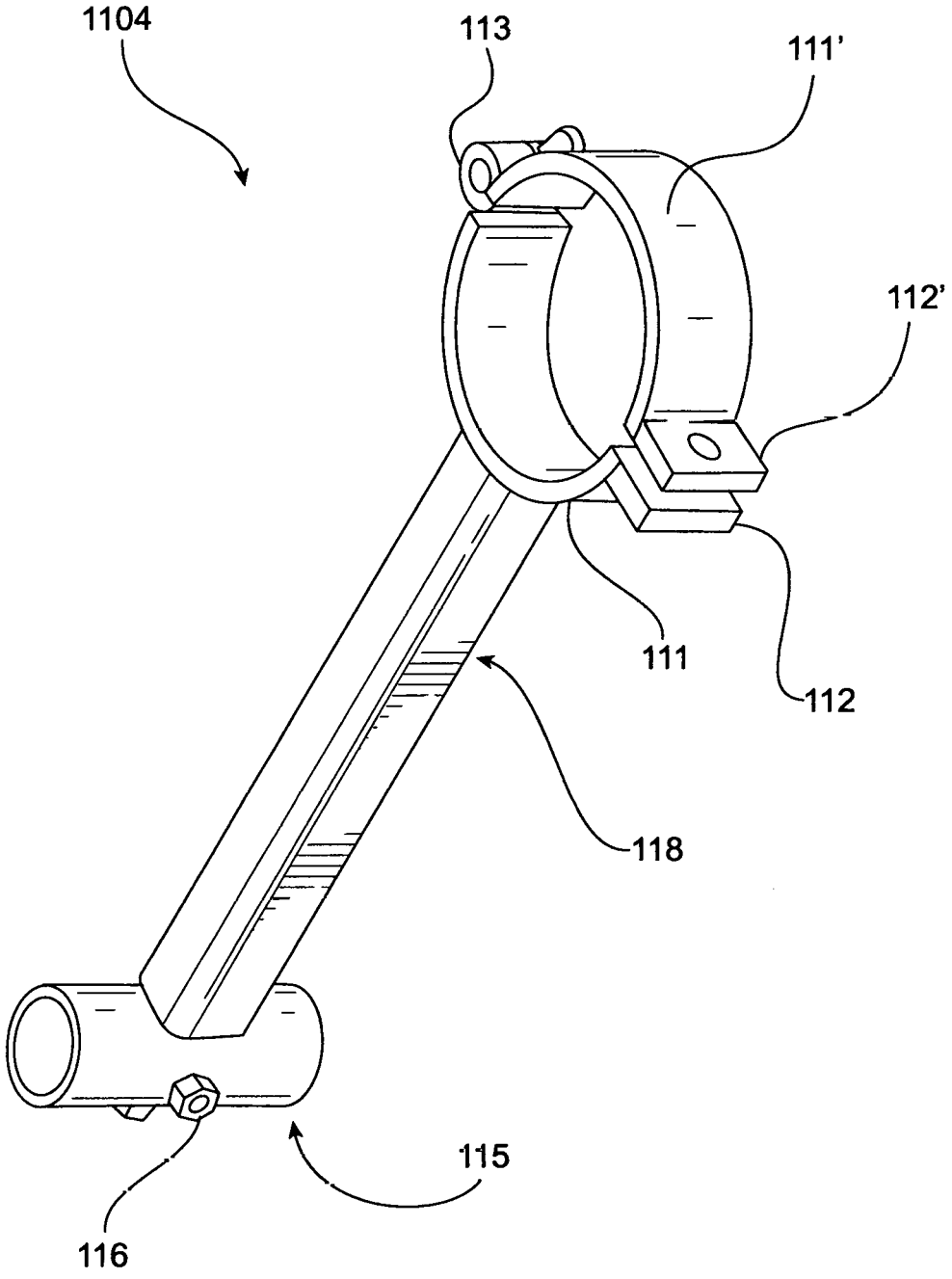
FIG. 8 is a perspective view of the pumping T clamp 1104 shown in FIG. 3
Figure 9A:
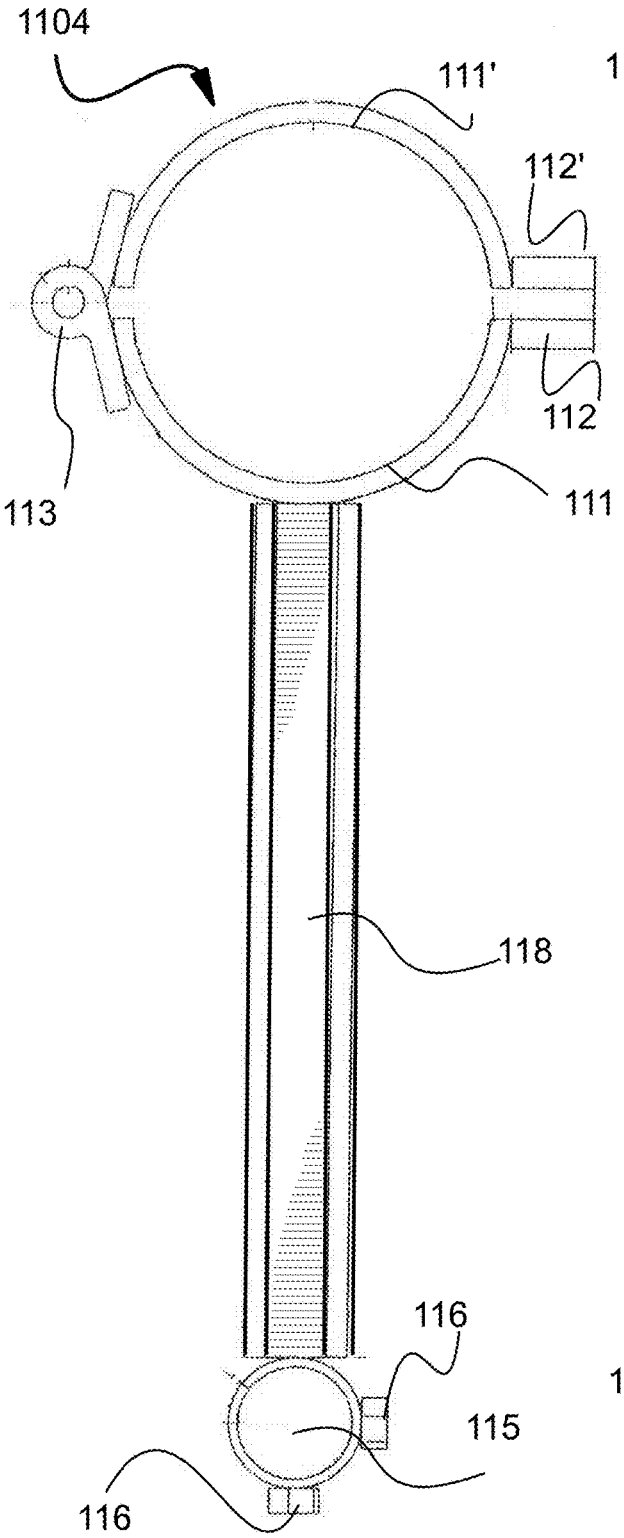
Figure 9B:
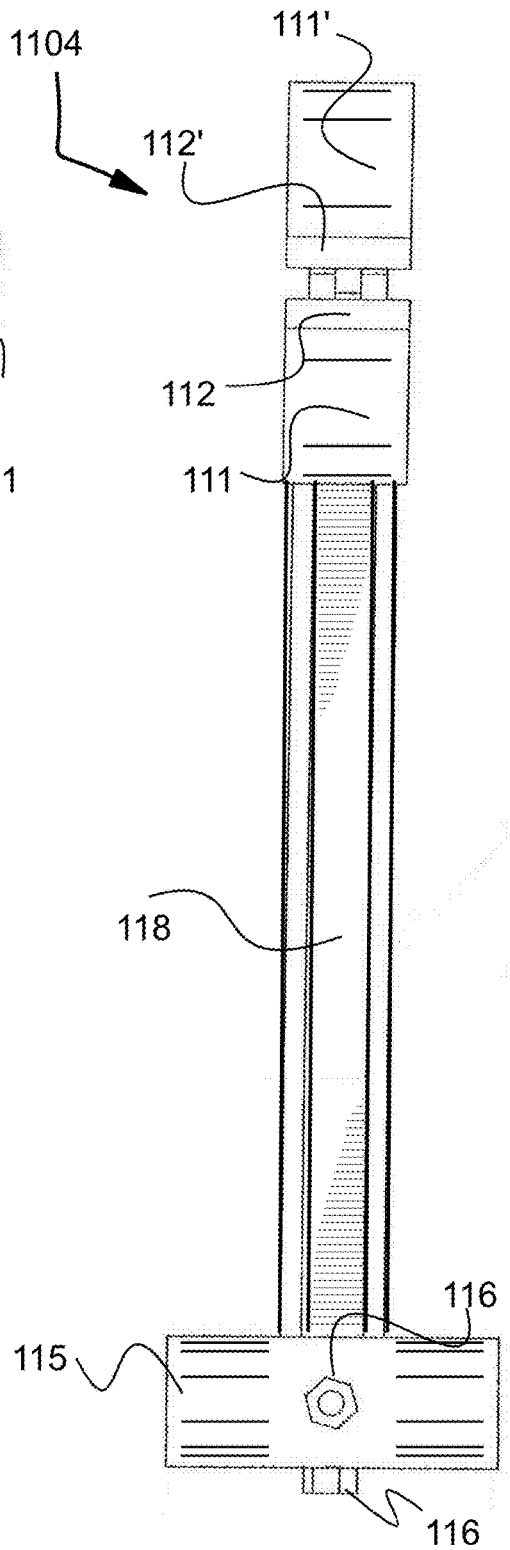
FIG. 9B is a top plan view thereof.
Figure 10:
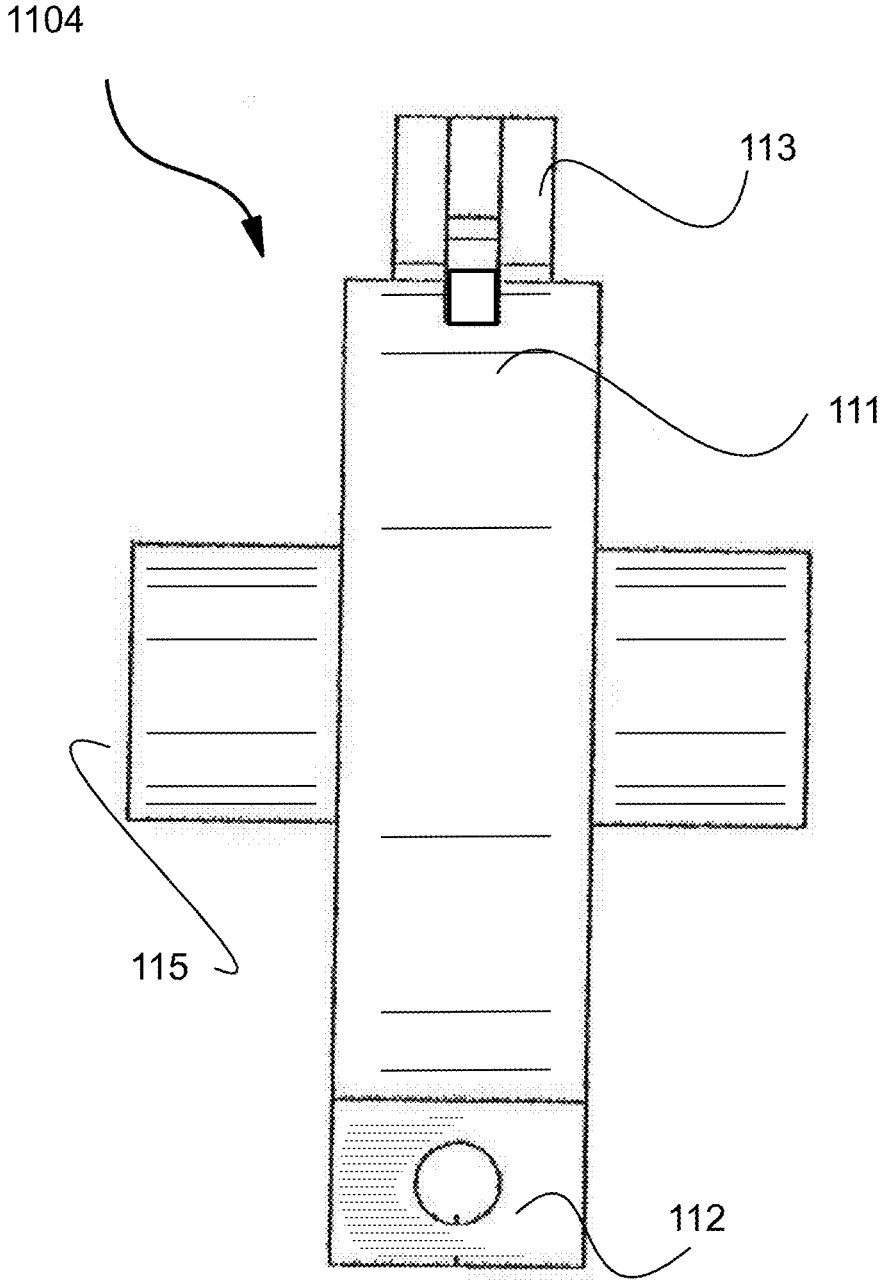
FIG. 10 is a front exterior elevation view of the pumping T clamp 1104 shown in FIG. 3.
Figure 11:
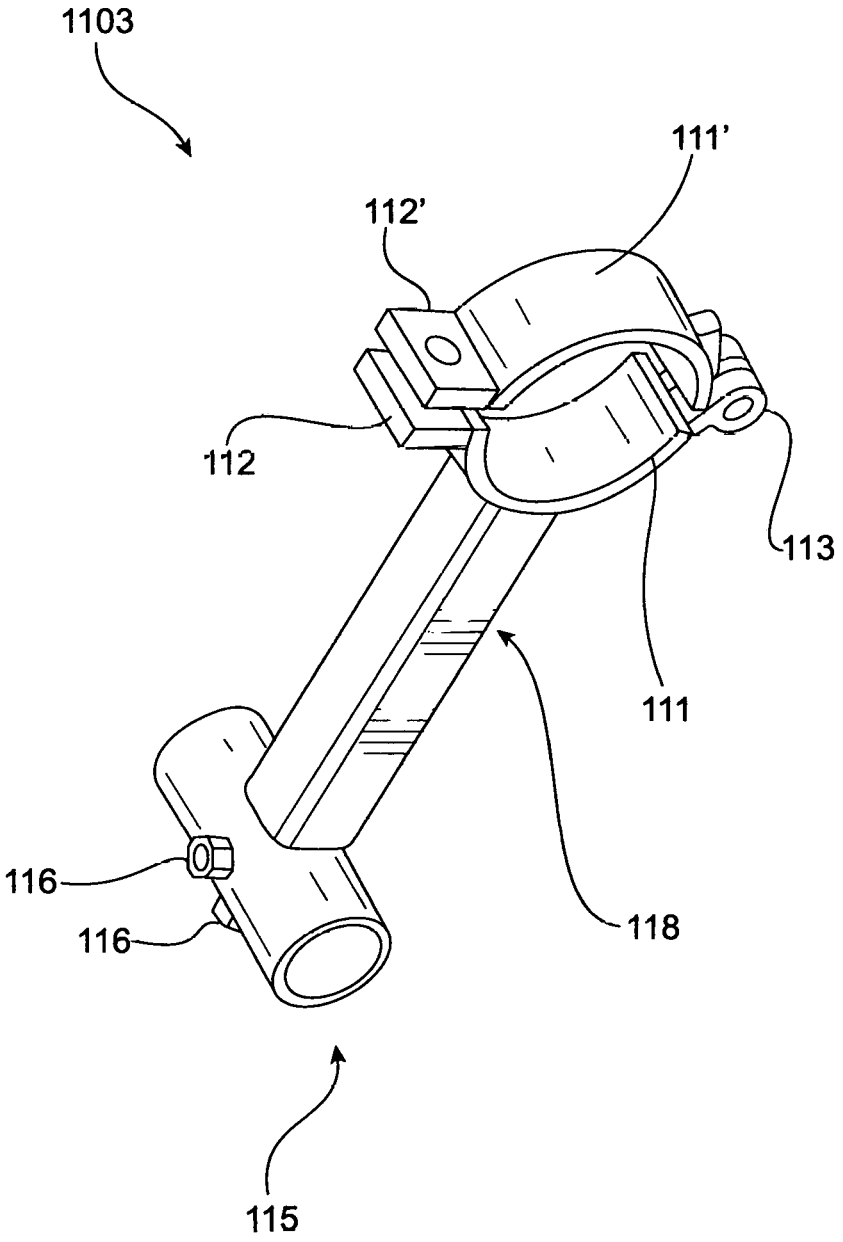
FIG. 11 is a perspective view of the tubing clamp 1103 shown in FIG. 3.
Figure 12:
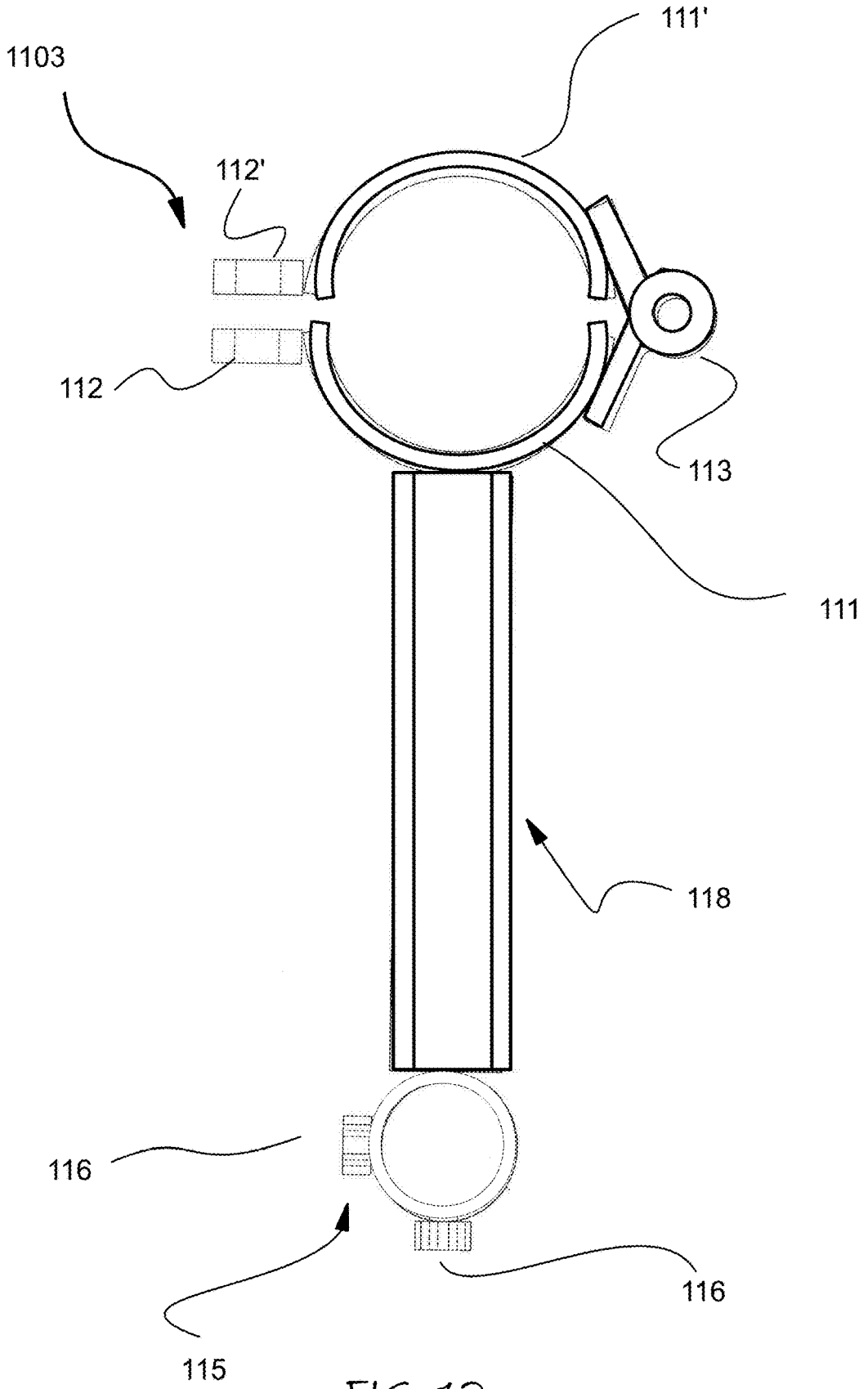
FIG. 12 is a top plan view of the tubing clamp 1103 shown in FIG. 3.
Figure 13A:
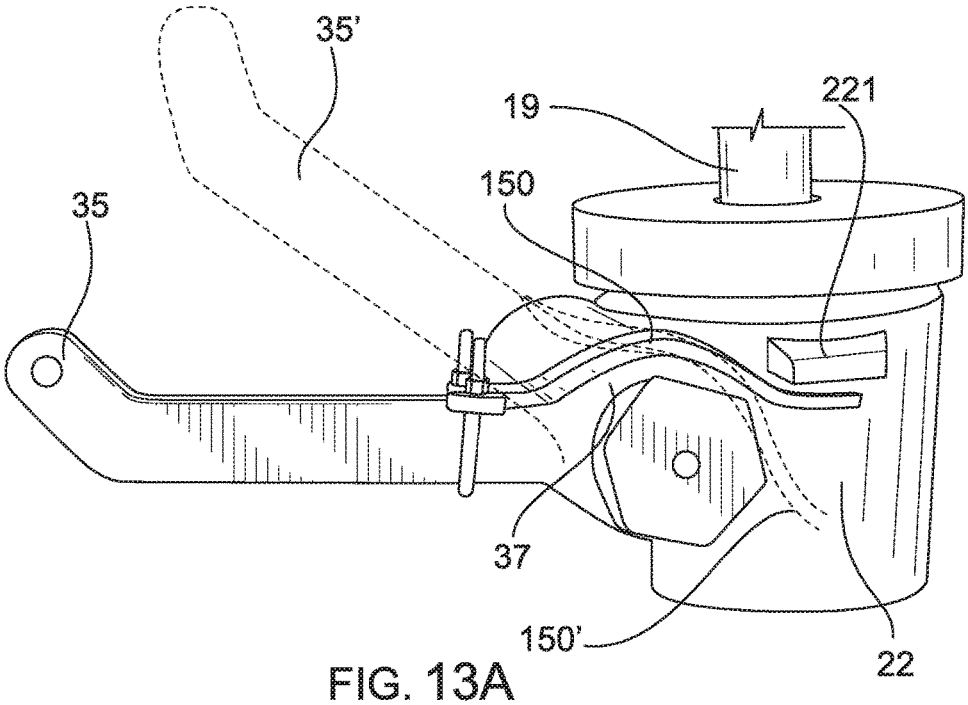
Figure 13B:
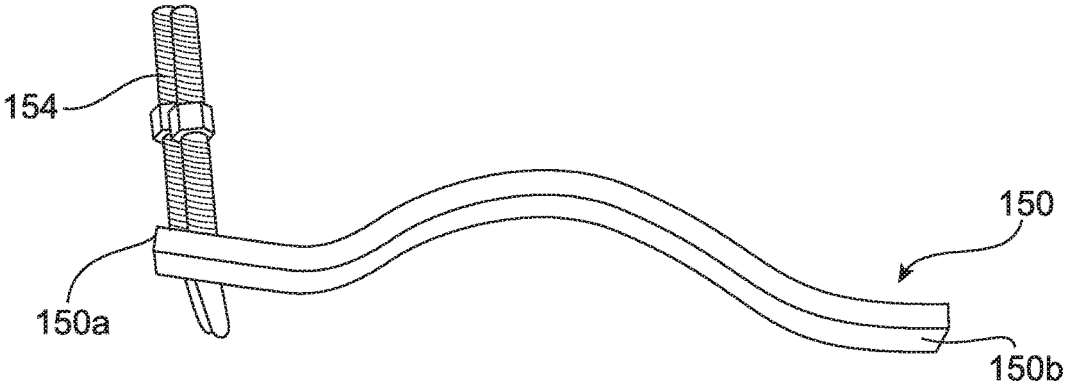
FIG. 13B is a perspective view of the arm stop isolated from the actuator.
Figure 13C:
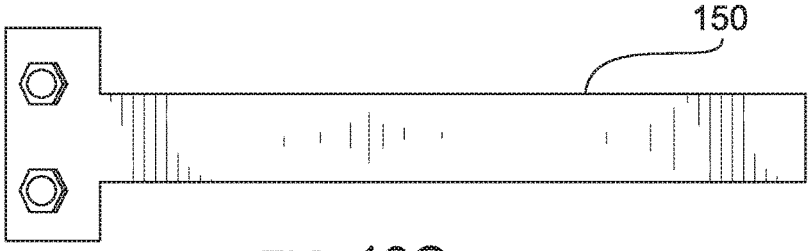
FIG. 13C is a top plan view of the arm stop.
Figure 14:
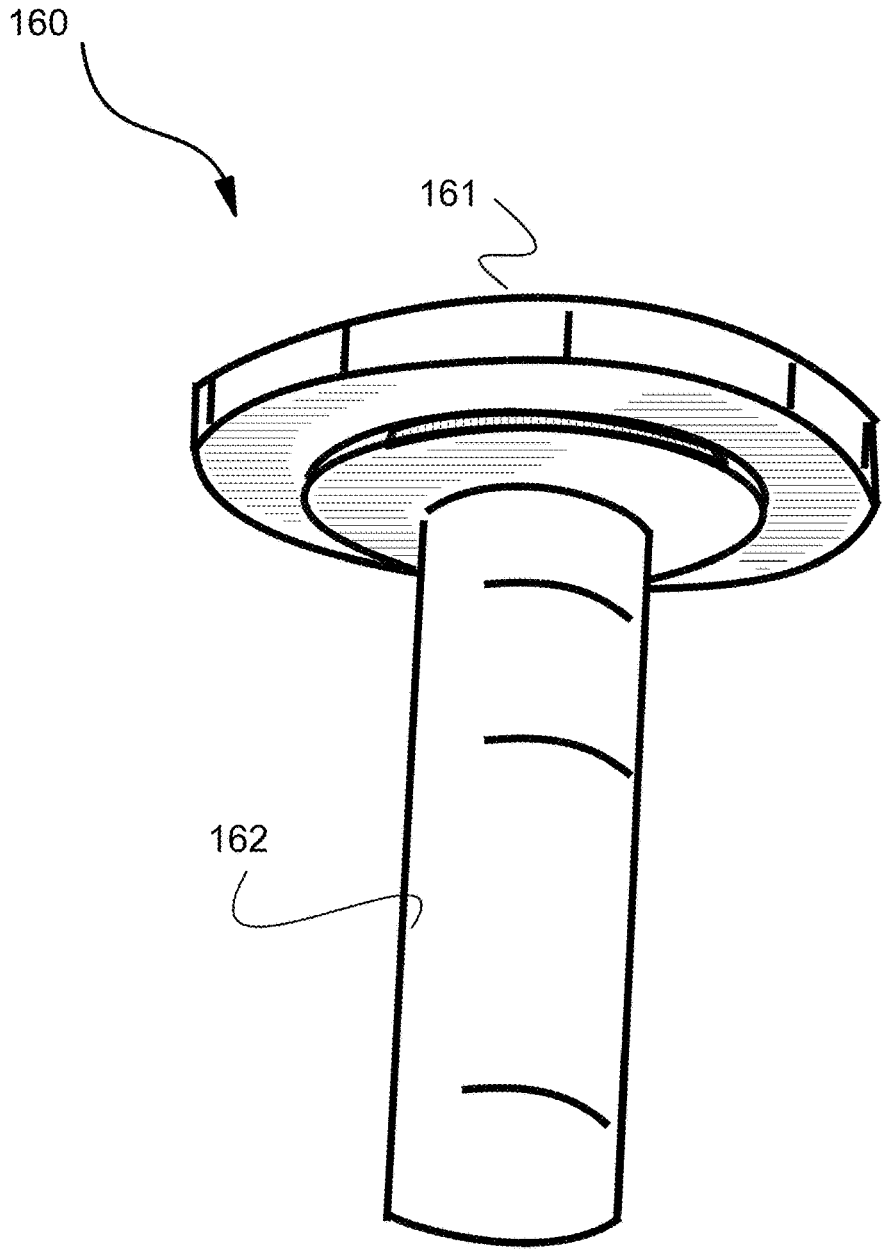
FIG. 14 is a perspective view of an insulating collar assembly.
Figure 15A:
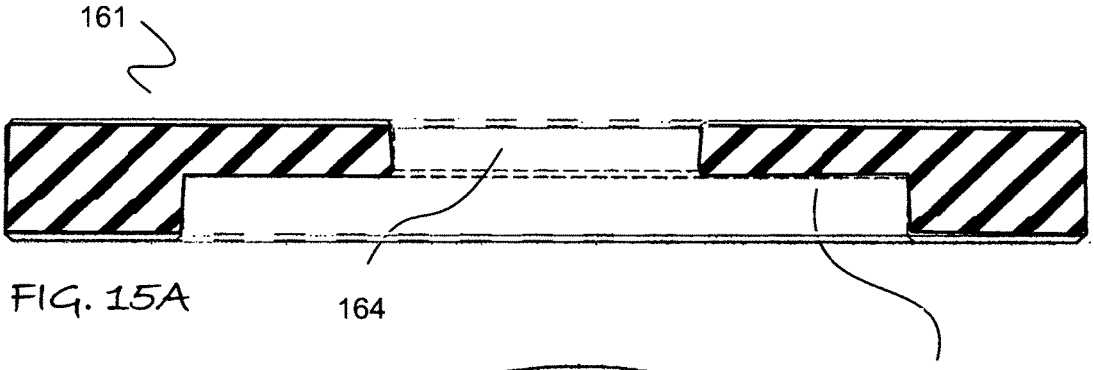
Figure 15B:
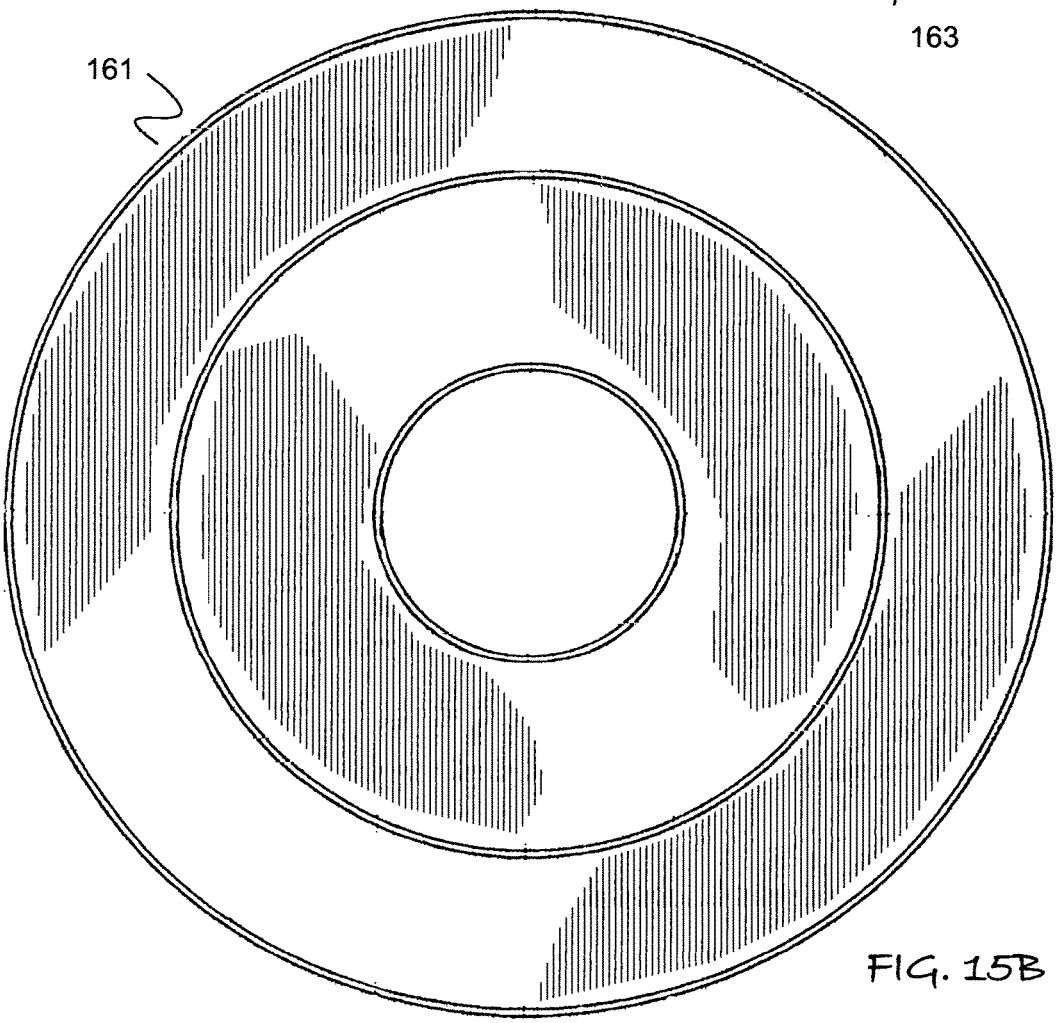
FIG. 15B is a top plan view thereof.
Figure 16:
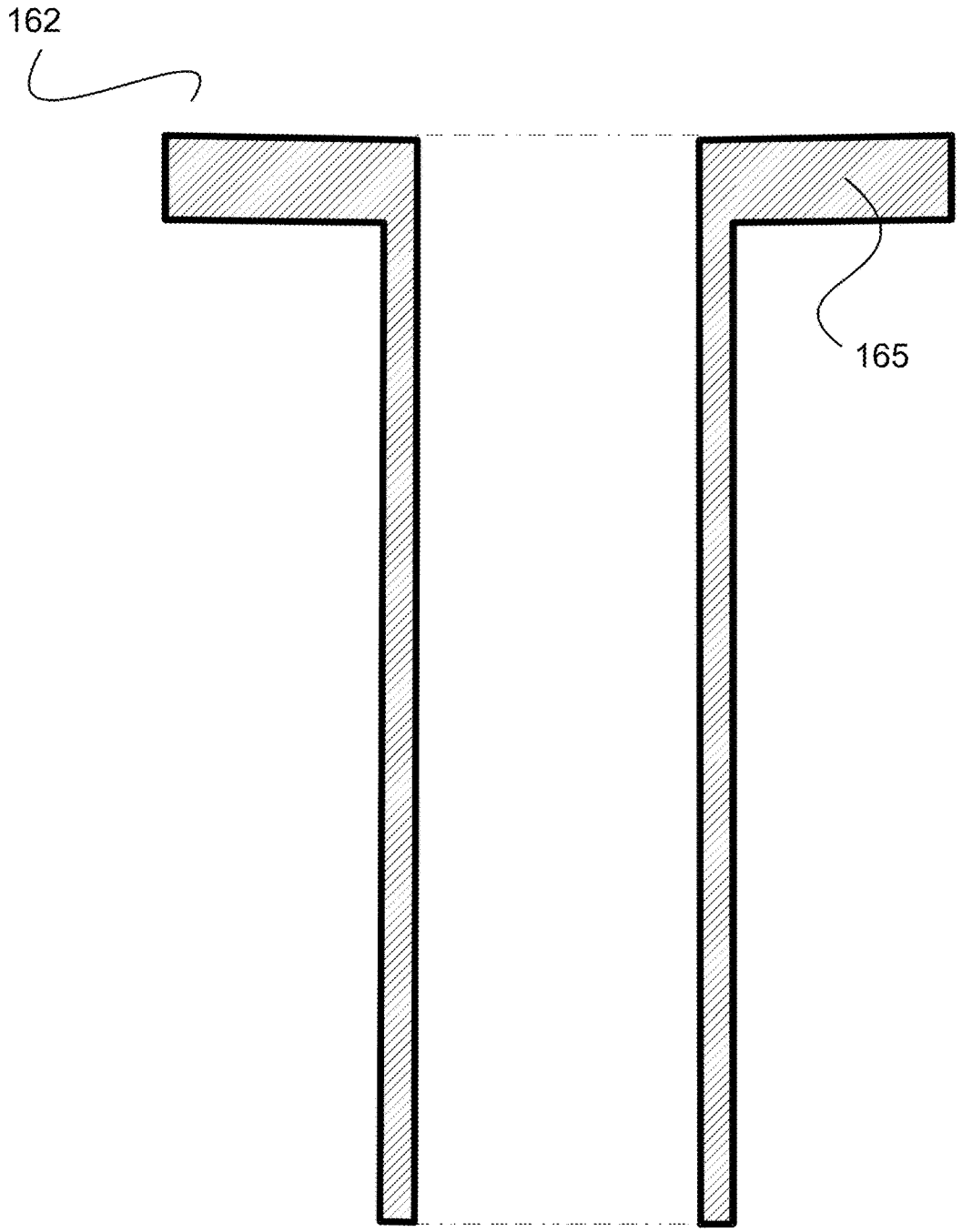
FIG. 16 is a cross-sectional elevation of the insulating tube portion of the insulating collar in FIG. 14.

More specifically, in one embodiment a stuffing box clamp 110 is attached to the stuffing box 14 as shown in FIG. 6-7. The stuffing box clamp 110 preferably has a laminated structure of the C-shaped portion 111 and 111' with the outer laminate layers 119 and 119' extending to the opposing end for to connect with tube 115. Laminates 119 are preferably held together by peripheral welds 1111 on the edges of the common C-shaped bodies 111 and 111' that is formed therefrom (FIG. 6). The portion of the outer laminate layers 119 and 119' that extend between the C-shaped bodies 111 and 111' respectively constitute the rigid spacer 118 between the well head clamping portion and the post receiving tube 115.

Alternatively, a tubing clamp 1103 can be deployed as shown in FIG. 4 to support upright post 120. The tubing clamp 1103 has a generally C-shaped pair of bodies 111 and 111' with a 3" diameter to clamp on the well head tubing below the stuffing box 14. The rigid linear spacer 118 is a tube.

The various wellhead and stuffing box clamps differ in structure primarily to place the bottom of the post in alternative locations, such as when a catch basin is used with the well head disposed below the catch basin and stuffing box. Hence, alternatively, a Pumping T clamp 1104 can be deployed as shown in FIG. 4 to support upright post 120. The Pumping T clamp generally has a pair of C-shaped bodies 111 and 111' with a 4" diameter to clamp on the well head tubing above a catch basin that is placed below and around the stuffing box 14. The rigid linear spacer 118 is a tube.

The various wellhead and stuffing box clamps 110, 1103 and 1104 are preferably metal that is plated with a corrosion resistant or inert layer, such as electroless nickel or cadmium plating. The stuffing box clamp 110 is preferably cadmium plated after assembly and welding of the laminate layers to the tube 115.

Another aspect of the invention is a kit that includes the one or more clamps, the post 120, saddle arms 130 and roller 140, as well as the arm stop 150. The arm stop 150 is shown in greatest details in FIG. 13A-C, and is preferably a flat bar bent in shape to conform to the shape of the actuator handle 35 and clamp to it.

The arm stop 150 of FIG. 2 and FIG. 13A-C prevents the actuator arm 35 from falling down, as it is designed to do when connected to a descending cable, which is eliminated by installation of the various embodiments of the invention. The arm stop 150 keeps the actuator arm 35 laterally disposed until the roller 140 contacts it from below to urge it upward on the down stroke of the sucker rod 19. The arm stop 150 has a proximal end 150*a* secured with a U clamp 154 around the arm 35, and a distal opposing end 150*b* that is placed under a lateral flange 221 on the actuator 22. The arm stop 150 is curved between the distal and proximal ends 150*a* and 150*b* to conform to the cylindrical housing 37 of the arm 35. Hence, the distal end 150*b* prevents CCW rotation of the Arm in FIG. 14A, but allows CW rotates as the curved portion slides over the cylindrical housing. The CW movement of the arm 35' and arm stop 150' is illustrated by broken lines.

The insulating collar 160 in FIGS. 3-4 and 14-16 is deployed between the sucker rod 19, sucker rod rotator 22 and carrier plate 16 (FIG. 3) and a load cell or sensor (not shown) on the well head and precludes electrical continuity to the rod string, reducing the potential for galvanic corrosion and electrolysis. The insulating collar 160 has a circular plate component 161 with a recessed or grooved annular portion 163 about a central bore 164 to receive an external flange 165 disposed on an upper end of the insulating tube 162. The circular plate 161 is preferably metal whereas the insulating tube 162 and attached external flange are preferably plastic but can be another strong dielectric material, such as rigid rubber or a reinforced fiber composite material and the like. The insulating collar comprises a circular metal plate with a recessed annular portion about the central bore with the insulating tube disposed in the recessed annular portion to provide a downward extension of the central bore. A kit may also include the insulated collar in which the components are bonded to form an integrated assembly.

In addition to reducing local wear on the sucker rod, the actuator arm wear is minimized by the soft roller which is supported to preclude jamming. The materials of construction are fatigue resistant and the roller life is extended by minimizing local wear from its rotation on each stroke of the sucker rod.

It should be appreciate that any of the components described as being attached or connected can be joined as an integrated assembly, or supplied in detachable components.

While the invention has been described in connection with a preferred embodiment, it is not intended to limit the scope of the invention to the particular form set forth, but on the contrary, it is intended to cover such alternatives, modifications, and equivalents as may be within the spirit and scope of the invention as defined by the appended claims.

I claim:

1. A sucker rod actuator stop comprising:

a) a clamp adapted for attaching proximal to an oil pumping well head and having a first cylindrical clamp and a second spaced apart clamp means, b) an upright post attached at a proximal end thereof to the second clamp means, the post having a distal end opposing the proximal end, c) a saddle bracket having a first and second outward extending upright arm connected at a common proximal end to the distal end of the upright post, each arm having a distal end opposite the proximal end in which the distal end of the first outward extending upright arm is spaced apart from the distal end of second outward extending upright arm, and d) a cylindrical roller having opposing sides about a cylindrical axis that is disposed in rotary engagement with the distal ends of the first and second outward extending upright arms of the saddle.

2. The sucker rod actuator stop of claim 1 wherein the cylindrical roller is selected from the group consisting of plastic, rubber, plastic coated metal core and a rubber coated metal core.

3. The sucker rod actuator stop of claim 1 wherein a top edge of the cylindrical roller is disposed above the distal end of each arm of the saddle bracket.

4. The sucker rod actuator stop of claim 1 wherein the clamp adapted for attaching proximal to an oil pumping well head is one of a wellhead clamp and a stuffing box clamp.

5. The sucker rod actuator stop of claim 1 wherein the clamp adapted for attaching proximal to an oil pumping well head is a wellhead clamp having a laminated structure with edge welds.

6. The sucker rod actuator stop of claim 5 wherein the wellhead clamp is plated over the laminated structure and edge welds.

7. The sucker rod actuator stop of claim 1 wherein the clamp adapted for attaching proximal to an oil pumping well head is adapted for attachment to a portion of a well head region by a clamp member having mirror image C-shape segment connected by a hinge at a common ends wherein the opposing ends of the C-shape segment distal from the hinge accepts a common bolt to draw the C-shape segments together around the portion of the well head.

8. A well head conversion kit comprising:

a) one or more means for clamping proximal to a well head, b) a post for attachment to the means for clamping proximal to a well head, wherein the one or more clamping means is operative to dispose the post spaced away from the well head with a primary axis of the post disposed parallel to a bore of the well, c) a saddle bracket for attachment to a top of the post distal from the attachment to means for clamping proximal to a well head, and d) a roller attached to a top of the saddle bracket and, e) an insulating collar that comprises a circular metal plate with a recessed annular portion about a central bore and an insulating tube disposed in the recessed annular portion to provide a downward extension of the central bore.

9. The well head conversion kit of claim 8 further comprising an insulating collar.

10. The well head conversion kit of claim 8 further comprising an arm stop.

11. The well head conversion kit of claim 10 further comprising an arm stop.

12. The well head conversion kit of claim 8 wherein the roller is selected from the group consisting of plastic, rubber, plastic coated metal core and a rubber coated metal core.

13. The well head conversion kit of claim 8 wherein the means for clamping is one of a wellhead clamp and a stuffing box clamp.

14. A well head conversion kit comprising:

a) one or more means for clamping proximal to a well head, b) a post for attachment to the means for clamping proximal to a well head, wherein the one or more clamping means is operative to dispose the post spaced away from the well head with a primary axis of the post disposed parallel to a bore of the well, a saddle bracket for attachment to a top of the post distal from the attachment to means for clamping proximal to a well head, and a roller attached to a top of the saddle bracket wherein the saddle bracket has a first and second outward extending upright arm connected at a common proximal end to the distal end of the upright post, each arm having a distal end opposite the proximal end in which the distal end of the first outward extending upright arm is spaced apart from the distal end of second outward extending upright arm.

15. A well head conversion kit comprising:

a) one or more means for clamping proximal to a well head, b) a post for attachment to the means for clamping proximal to a well head to dispose the post is spaced away from the well head with a primary axis of the post disposed parallel to a bore of the well, c) a saddle bracket for attachment to a top of the post distal from the attachment to means for clamping proximal to a well head, and a roller attached to a top of the saddle bracket wherein a top edge of the roller is disposed above the distal end of each arm of the saddle bracket.

16. A process for engaging a sucker rod actuator on a well head, the process comprising the steps of:

a) providing a sucker rod actuator stop comprising:

i) a clamp adapted for attaching proximal to an oil pumping well head and having a first cylindrical clamp and a second spaced apart clamp means, ii) an upright post attached at a proximal end thereof to the second clamp means, the post having a distal end opposing the proximal end, iii) a saddle bracket having, a first and second outward extending upright arm connected at a common proximal end to the distal end of the upright post, each arm having a distal end opposite the proximal end in which the distal end of the first outward extending upright arm is spaced apart from the distal end of second outward extending upright arm, and iv) a cylindrical roller having opposing sides about a cylindrical axis that is disposed in rotary engagement with the distal ends of each of the upright arms of the saddle, b) attaching the clamp to said oil pumping well head at the first cylindrical clamp to space the second spaced apart clamp away from a bore of the well head to dispose the cylindrical roller below an actuator handle of a sucker rod rotator, c) wherein on each down stroke of the sucker rod the actuator handle will contact the cylindrical roller on the top of upright post thereby activating the rotator to rotate the sucker rod.

17. The process for engaging a sucker rod actuator on a well head according to claim 16 wherein the cylindrical roller rotates on each successive down stroke to disperse the wear thereof over a radial portion of the roller.

18. The process for engaging a sucker rod actuator on a well head according to claim 16 further comprising the step of attaching an arm stop to the sucker rod actuator to prevent the actuator handle from rotating downward below a horizontal position on each down stroke.

19. The process for engaging a sucker rod actuator on a well head according to claim 16 wherein the cylindrical roller is selected from the group consisting of plastic, rubber, plastic coated metal core and a rubber coated metal core.

* * * * *